US008127549B2

(12) United States Patent
Miura et al.

(10) Patent No.: US 8,127,549 B2
(45) Date of Patent: Mar. 6, 2012

(54) BURNER AND GAS TURBINE COMBUSTOR

(75) Inventors: Keisuke Miura, Hitachi (JP); Hiroshi Inoue, Mito (JP); Kazuhito Koyama, Hitachi (JP); Takeo Saito, Hitachinaka (JP); Satoshi Dodo, Kasama (JP)

(73) Assignee: Hitachi, Ltd., Tokyo (JP)

( * ) Notice: Subject to any disclaimer, the term of this patent is extended or adjusted under 35 U.S.C. 154(b) by 663 days.

(21) Appl. No.: 12/323,654

(22) Filed: Nov. 26, 2008

(65) Prior Publication Data

US 2009/0173075 A1 Jul. 9, 2009

(30) Foreign Application Priority Data

Nov. 29, 2007 (JP) ..... 2007-308159

(51) Int. Cl.
*F02C 1/00* (2006.01)

(52) U.S. Cl. ..... 60/737; 60/746

(58) Field of Classification Search ..... 60/737, 60/739, 740, 742, 746, 747; 431/8, 174, 431/179

See application file for complete search history.

(56) References Cited

U.S. PATENT DOCUMENTS 5,437,158 A * 8/1995 Fric ..... 60/739
6,912,854 B2 * 7/2005 Inoue et al. ..... 60/737
2004/0011054 A1 1/2004 Inoue et al.
2008/0229755 A1 * 9/2008 Koganezawa et al. ..... 60/775
2008/0268387 A1 * 10/2008 Saito et al. ..... 431/8

FOREIGN PATENT DOCUMENTS

| | | | |
|---|---|---|---|
| CN | 1401938 | A | 3/2003 |
| JP | 5-264009 | A | 10/1993 |
| JP | 6-147418 | A | 5/1994 |
| JP | 09-318061 | | 12/1997 |
| JP | 2003-148734 | | 5/2003 |
| JP | 2005-030667 | | 2/2005 |
| JP | 2006-017381 | | 1/2006 |
| JP | 2006-189252 | | 7/2006 |
| JP | 2007-146697 | A | 6/2007 |

* cited by examiner

*Primary Examiner* — Louis Casaregola
*Assistant Examiner* — Phutthiwat Wongwian
(74) *Attorney, Agent, or Firm* — Mattingly & Malur, PC

(57) ABSTRACT

A burner is provided that has high flame stability and reduces NOx emissions.

In the burner, air holes of an air hole member have a central axis inclined relative to a burner central axis. The leading end portion of a first fuel nozzle is configured to be able to suppress turbulence of air-flow flowing on the outer circumference side of the first fuel nozzle. The tip of the first fuel nozzle is located on a fuel jetting-out directional downstream side of the inlet of the fuel hole. The tip of the second fuel nozzle is located on a fuel jetting-out directional downstream side of the air hole inlet.

7 Claims, 14 Drawing Sheets

BURNER AND GAS TURBINE COMBUSTOR

BACKGROUND OF THE INVENTION

1. Field of the Invention

The present invention relates to a burner, a gas turbine combustor and a combustor retrofit method.

2. Description of the Related Art

Since public attention has been focused on environmental and energy resource issues, various approaches have been done in several fields over the long term. Also in gas turbines, technologies are developed for achieving high efficiency by increasing the temperature of combustion gas discharged from a combustor and for realizing low NOx combustion, so that outstanding advancements are achieved. However, reduction in NOx emissions required grows severe with times and efforts are undertaken to further reduce NOx emissions.

JP-A-9-318061 discloses a gas turbine combustor which combines a diffusion burner and a premix burner.

SUMMARY OF THE INVENTION

Gas turbine combustors have significantly reduced a NOx emission level by switching from diffusion combustors to premix combustor. However, the gas turbines need to be operated under wide conditions from start to a rated load; therefore, a combustor is provided at a central portion with a pilot burner having high flame stability. In JP-A-9-318061, a diffusion burner is used as the pilot burner to stabilize flames under wide conditions. Compared with the diffusion combustor, the gas turbine combustor of JP-A-9-318061 largely reduces NOx emissions as the entire gas turbine. However, since the pilot burner employs a diffusion combustion type, a reduction in NOx emissions is limited.

Further reducing NOx emissions need to switch the pilot burner from the diffusion burner to a burner with small NOx emissions and the pilot burner is required to achieve a balance between high flame stability and low NOx performance.

It is an object of the present invention to provide high flame stability and reduce NOx emissions.

According to an aspect of the present invention, there is provided a burner in which air holes of an air hole member have a central axis inclined relative to a burner central axis, a leading end portion of a first fuel nozzle is configured to be able to suppress turbulence of air-flow flowing on the outer circumference side of the first fuel nozzle, a tip of the first fuel nozzle is located on a fuel jetting-out directional downstream side from an inlet of the fuel hole, and a tip of the second fuel nozzle is located on a fuel jetting-out directional upstream side of the inlet of the air hole.

The aspect of the burner of the invention has high flame stability and can reduce NOx emissions.

DESCRIPTION OF THE PREFERRED EMBODIMENTS

Preferred embodiments of the present invention will hereinafter be described with reference to the drawings.

First Embodiment

Figure 1A:
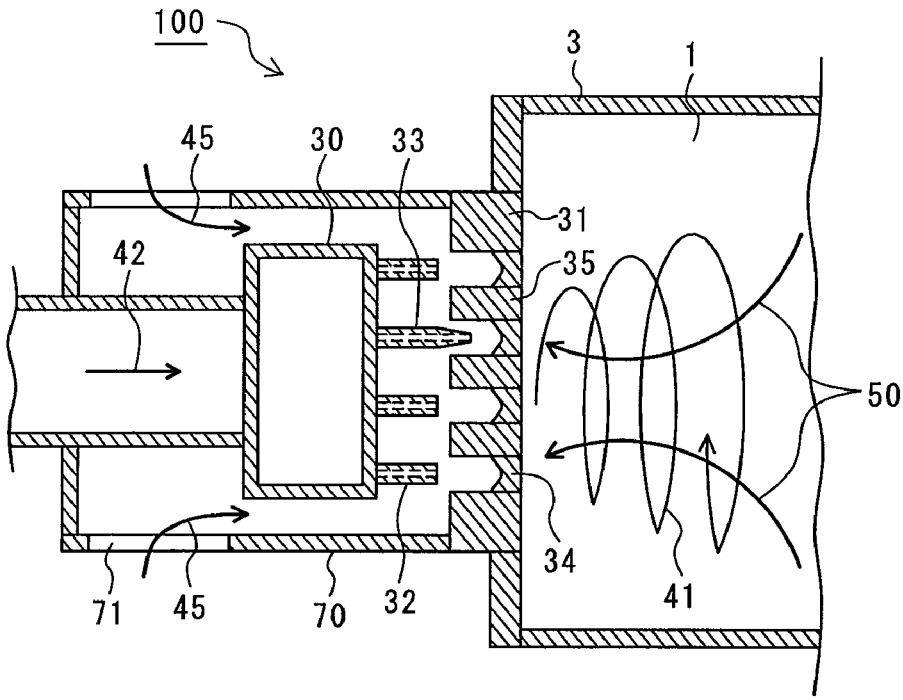
FIG. 1A is a lateral cross-sectional view of a burner according to a first embodiment of the present invention, taken along line X-X of FIG. 1B.
Figure 1B:
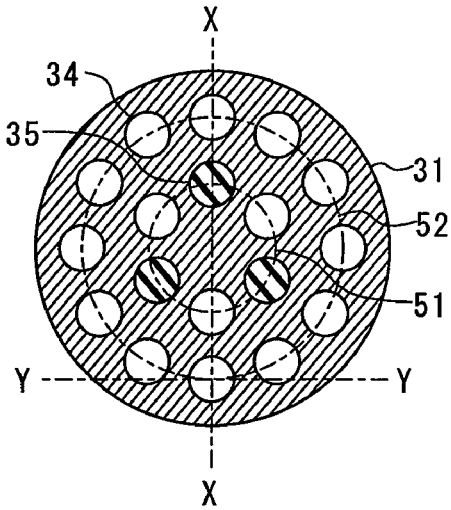
FIG. 1B is a front cross-sectional view of the burner.
Figure 1C:
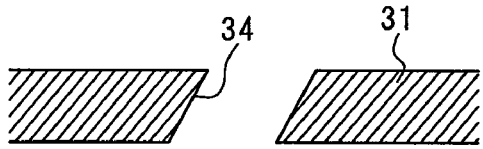
FIG. 1C is a cross-sectional view taken along line Y-Y of FIG. 1B.

FIG. 1A is a lateral cross-sectional view of a burner according to a first embodiment, taken along line X-X of FIG. 1B. FIG. 1B is a front view of an air hole member 3 as viewed from a chamber 1. FIG. 1C is a cross-sectional view taken along line Y-Y of FIG. 1B. In the embodiment, each of all air holes has a central axis inclined with respect to a burner central axis. Specifically, as shown in FIG. 1C, the path central axis of each air hole is inclined in the circumferential direction of the air hole member 31. For this reason, when the air hole member 31 is cut in X-X section, the inclination of the air hole is apparently depicted as in FIG. 1A.

The burner 100 of the embodiment includes a fuel header 30 adapted to distribute fuel to a plurality of fuel nozzles 32, 33 on the downstream side thereof; the fuel nozzles 32, 33 joined to the fuel header 30 to jet out fuel into the plurality of air holes; and the air hole member 31 provided with the air holes 34, 35. The air hole member 31 is disposed on an upstream side wall surface of the chamber 1. The fuel header 30 is accommodated in a cylindrical fuel header housing section 70. The fuel header housing section 70 is provided with air inflow holes 71 on the upstream side of the fuel header 30. The embodiment uses gaseous fuel as fuel.

The air holes 34, 35 are each provided such that an air flow passage central axis is inclined with respect to the central axis of the burner 100. Air 45 inflowing from the air inflow holes 71 passes through the air holes 34,35 and jets out into the chamber 1 to form swirl flow 41 at the downstream of the burner. Recirculation flow 50 occurs at the center of the swirl flow 41 to create a low velocity zone. Thus, flames originating from the low-velocity zone can be kept. As shown in the front view of the burner, the air holes of two rows are concentrically arranged from the center of a burner plane center. Incidentally, in FIG. 1B, the burner plane center corresponds to a central point of the circular air hole member 31.

The fuel 42 flowing in the fuel header 30 is distributed to the fuel nozzles 32, 33. A fuel nozzle 32 is paired with a corresponding one of the air holes 34, and a fuel nozzle 33 is paired with a corresponding one of the air holes 35. Fuel jet jetted out from each fuel nozzle passes through the corresponding air hole and flows into the chamber 1. Each pair has a positional relationship such that the central axis of the fuel nozzle passes in the vicinity of the center of an air hole inlet located at the upstream side end face of the air hole.

Incidentally, the air hole inlet is provided in a plane of the air hole member 31 on a fuel flow directional upstream side (i.e., in a left lateral surface of the air hole member 31 in the lateral view of FIG. 1A). An axis formed vertical to the air hole member 31 to pass through the center of the plane formed in the air hole inlet is defined as "the central axis of the air hole inlet".

As shown in the front view of the burner, the air holes 35 paired with the corresponding respective fuel nozzles 33 are concentrically arranged only in a first row 51 of the two rows of air holes and alternately with the air holes 34 paired with the corresponding respective fuel nozzles 32.

Figure 2:
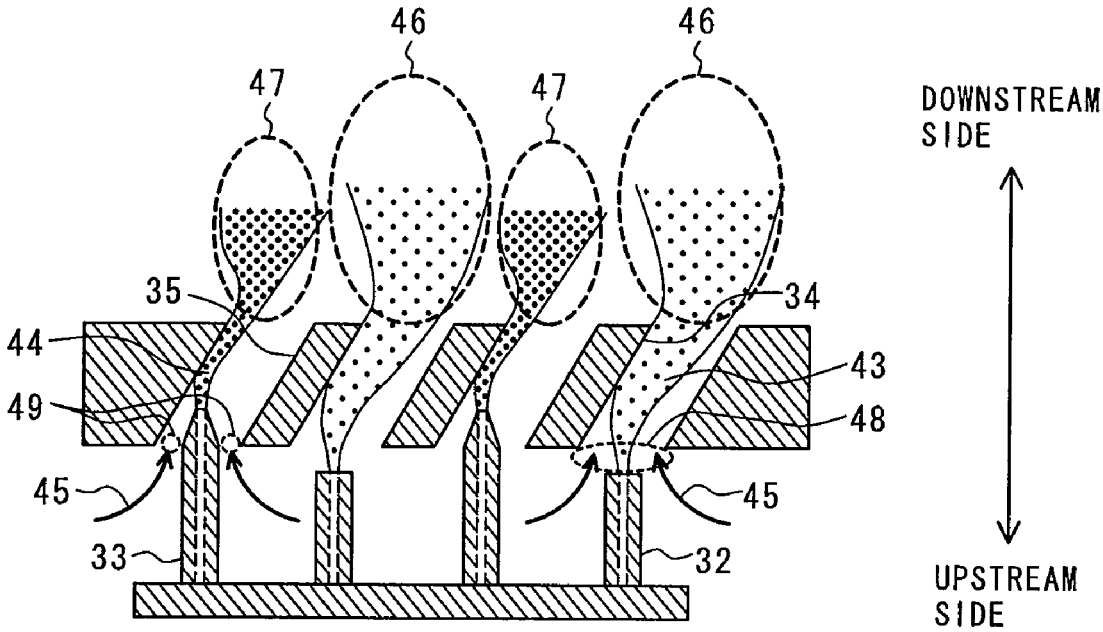
FIG. 2 is a circumferential development view partially illustrating the air holes and fuel nozzles of a first row in the first embodiment.

FIG. 2 is a circumferential development view partially illustrating the air holes and fuel nozzles of the first row 51.

A description is given of a combination of the fuel nozzle 32 and the air hole 34. The tip of the fuel nozzle 32 is disposed in the vicinity of the inlet of the air hole 34. Specifically, the tip of the fuel nozzle 32 is located on the upstream of the air hole 34 to face the inlet (the upstream side end face) thereof. Thus, the fuel jet 43 jetted out from the fuel nozzle 32 flows into the air hole 34. Air 45 having flowed into the air hole 34 flows while surrounding the fuel jet 43 inside the air hole 34. Thus, the fuel jet 43 and the air 45 are jetted out into the chamber 1 while mixing with each other. At the instant when the fuel jet 43 and the air 45 are jetted out from the air hole 34 into the chamber 1, the mixing thereof progresses so that flame formed in a downstream zone 46 of the air hole 34 becomes premix flame, which reduces NOx emissions.

A description is next given of a combination of the fuel nozzle 33 with the air hole 35. The tip of the fuel nozzle 33 is disposed in the vicinity of the inlet of the air hole 35. Specifically, the tip of the fuel nozzle 33 is located on the downstream side of the inlet (the upstream side end face) of the air hole 35 and inserted into the inside of the air hole 35. Thus, an opening area of an air hole inlet portion 49 provided on the upstream side of the air hole 35 is narrowed by the fuel nozzle 33. Consequently, the amount of air flowing into the air hole 35 is relatively smaller than that flowing into the air hole 34.

Since the fuel nozzle 33 is inserted into the air hole 35 formed to have an angle of traverse, the fuel jet 44 jetted out from the fuel nozzle 33 collides with and flows along an internal wall surface of the air hole 35 toward the downstream side. Thus, the fuel jet 44 is jetted out into the chamber 1 without mixing with the air 45, compared with the combination of the fuel nozzle 32 with the air hole 34. Since the leading end portion of the fuel nozzle 33 is tapered, the turbulence of the air 45 can be prevented from occurring at the leading end portion of the fuel nozzle 33. Thus, the mixing of the fuel jet 44 with the air 45 can be suppressed.

Seen from FIG. 2, desirably, the inclination angle of the air hole is such an angle that at least the fuel jetted out from the fuel nozzle 33 can collide with the inner wall of the air hole. This is because when the inclination angle of the air hole central axis with respect to the burner central axis is too small, the fuel jetted out from the fuel nozzle 33 is discharged into the chamber 1 without collision with the internal wall of the air hole. The air hole member 31 requires such a thickness that the fuel jetted out from the fuel nozzle 33 can collide with the internal wall of the air hole in relation to the inclination angle of the air hole. This is because when the thickness of the air hole member 31 is too small, fuel may be discharged into the chamber 1 without collision with the air hole inner wall in some cases.

Figure 3:
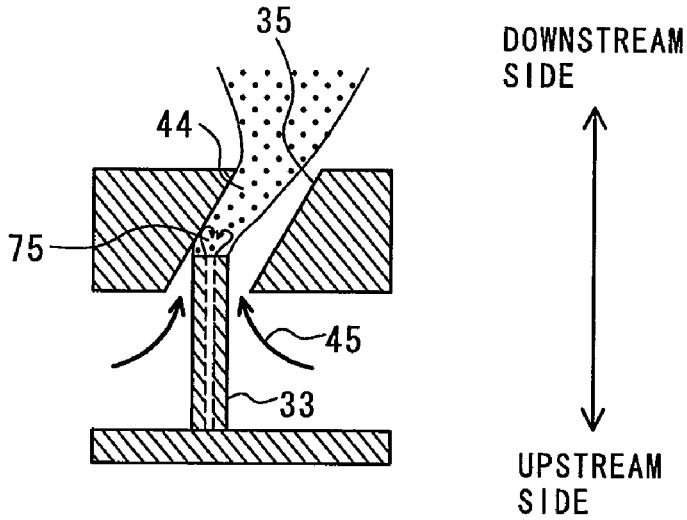
FIG. 3 is a schematic lateral cross-sectional view illustrating a combination of a cylindrical fuel nozzle with an air hole and flow of air and fuel.

FIG. 3 is a schematic diagram illustrating the arrangement relationship between the fuel nozzle 33 and the air hole 35 in the case where the fuel nozzle 33 is cylindrically shaped to have a non-tapered leading end portion, and also illustrating the flow of fuel and of air. When the fuel nozzle 33 is shaped to extend straightly cylindrically to the tip thereof, the flow of the air 45 changes in a step-like manner at the tip of the fuel nozzle to produce vortexes 75, which causes strong turbulence. The vortexes 75 swirls the fuel jet 44 and the air 45 for mixing them. With the configuration of FIG. 3, although the amount of air flowing into the air hole 35 can be reduced, since the mixing of fuel with air progresses, flames formed in the downstream zone 47 of the air hole 35 become premix flames. In contrast to this, the leading end portion of the fuel nozzle 33 is tapered to thereby reduce the turbulence of air flow at the leading end portion of the fuel nozzle. Thus, diffusion flames with high combustion stability can be formed in the downstream zone 47 of the air hole 35.

Figure 21:
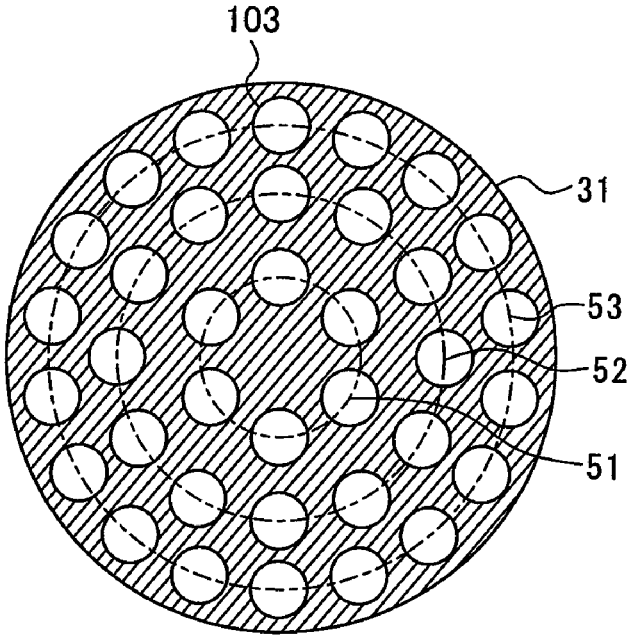
FIG. 21 is a front view of a burner according to a comparative example.
Figure 22:
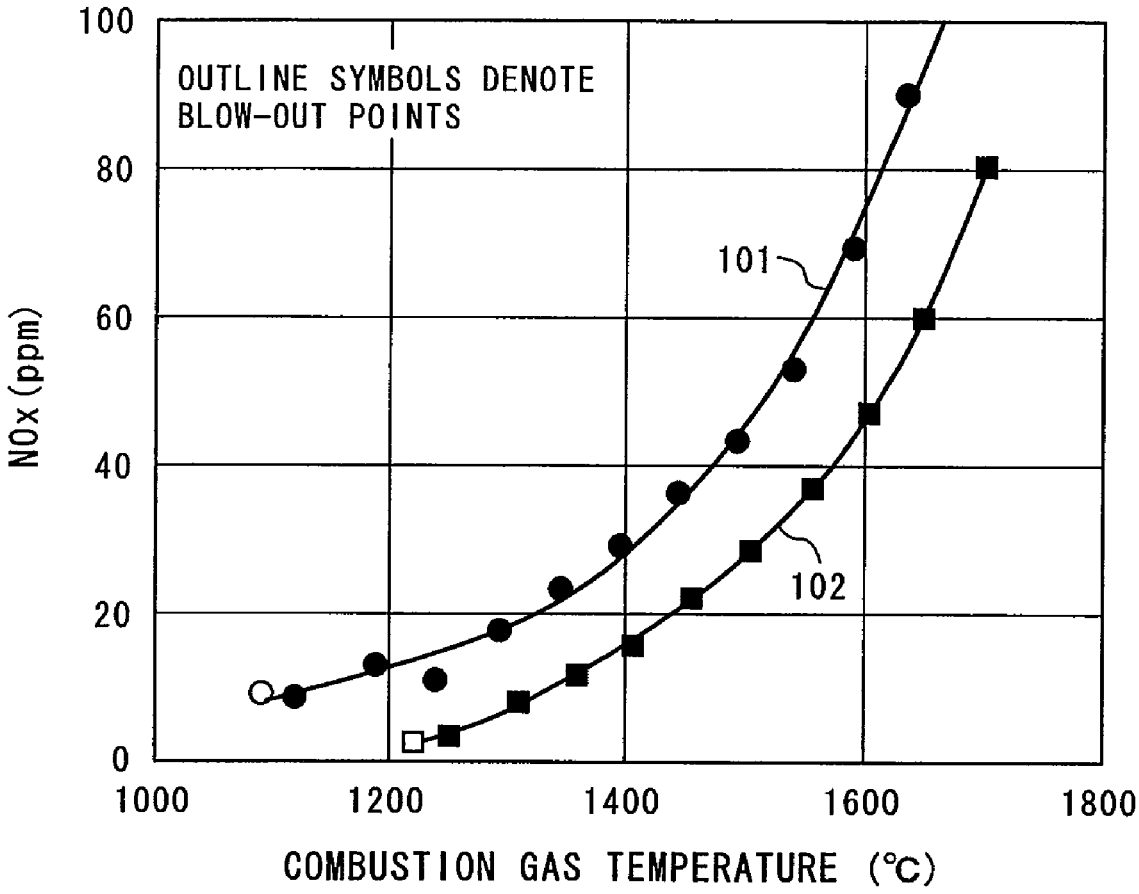
FIG. 22 is a graph illustrating comparison between combustion characteristics (NOx, Blow out temperature).

Now, an air hole member of a comparative example is depicted in FIG. 21 as viewed from a chamber. FIG. 22 illustrates a difference in combustion property resulting from a difference of fuel nozzles in a burner having a plurality of air holes 103 as shown in FIG. 21 and fuel nozzles arranged on the upstream side of the air holes. Incidentally, six air holes of a first row 51 from the burner plane center shown in FIG. 21 each has an air hole central axis inclined relative to the burner central axis. In FIG. 22, an abscissa axis represents combustion gas temperature and an ordinate axis represents NOx emissions. Outline symbols denote blow-out points in FIG. 22.

A curve 101 in the figure indicates combustion property of a burner in which the respective leading end portions of all fuel nozzles are shaped to be tapered and are inserted into the corresponding air holes as the fuel nozzles 33 in FIG. 2. Likewise, a curve 102 in the figure indicates combustion property of a burner in which the respective leading end portions of all fuel nozzles are shaped cylindrical and inserted into the corresponding air holes as the fuel nozzles 33 in FIG. 3. As seen from the comparison between such two curves, the curve 101 shows that although NOx has higher values over the entire combustion gas temperatures, the combustion gas temperature extends to a zone lower by 100° C. or more than that of the curve 2. FIG. 22 shows that the tapered leading end portion of the fuel nozzle provides a slightly higher NOx but can keep flames even at lower combustion gas temperatures, which improves flame stability.

In other words, the combination of the air hole provided with the inclination angle and the fuel nozzle having the tapered leading end portion can more suppress the mixing of fuel with air than the combination of the air hole provided with the inclination angle and the cylindrical fuel nozzle. For this reason, the fuel and air are jetted out into the chamber while being insufficiently mixed with each other. In this way, since a fuel-rich zone exists at the outlet of the air hole of the first row 51 from the burner center where a flame base is formed, a diffusion combustion zone can be formed.

As described above, the fuel jet 44 and the air 45 are jetted out from the air holes 35 while being not virtually mixed with each other and the amount of air is further reduced. Thus, diffusion flames are formed in the downstream zone 47 of the air hole 35, which can provide very stable combustion and keep stable flames under wide operating conditions.

As shown in FIG. 1B of the front view and in FIG. 2, the pairs of the fuel nozzle 32 and the air hole 34 and the pairs of the fuel nozzle 33 and the air hole 35 are alternately arranged on a circle. Therefore, as shown in FIG. 2, the premix flames and the diffusion flames are alternately and continuously formed in the downstream zones 46 and 47, respectively. Since the diffusion combustion zone provides high-stability, combustion can stably be continued under wide conditions. In addition, since the premix combustion zone receives heat and radicals supplied from the diffusion combustion zone, combustion is stable even under low combustion temperature conditions.

Since the air holes of the first row have the inclination angle with respect to the burner central axis, the fuel jet and air flow are jetted out from the air holes of the first row into the chamber while conically spreading. Therefore, also the premix gas jetted out from the air holes 34 of the second row 52 similarly premix-burn while receiving heat and radicals supplied from the flames formed at the burner central portion. Specifically, very stable inverse-conical flames are formed originating in the diffusion combustion zone formed in the downstream zone 47 of the air holes 35. In addition, since the premix combustion zones prevail over the entire flames, the NOx emissions can be suppressed to a low level.

Incidentally, it is possible that the air holes of the first row use only the fuel nozzles 32 and the air holes of the second row use the combination of the fuel nozzle 32 and the fuel nozzle 33. Also in this case, it is probable that since the inverse-conical flames formed by the burner partially form the diffusion combustion zone, the entire flames have stability.

Figure 4:
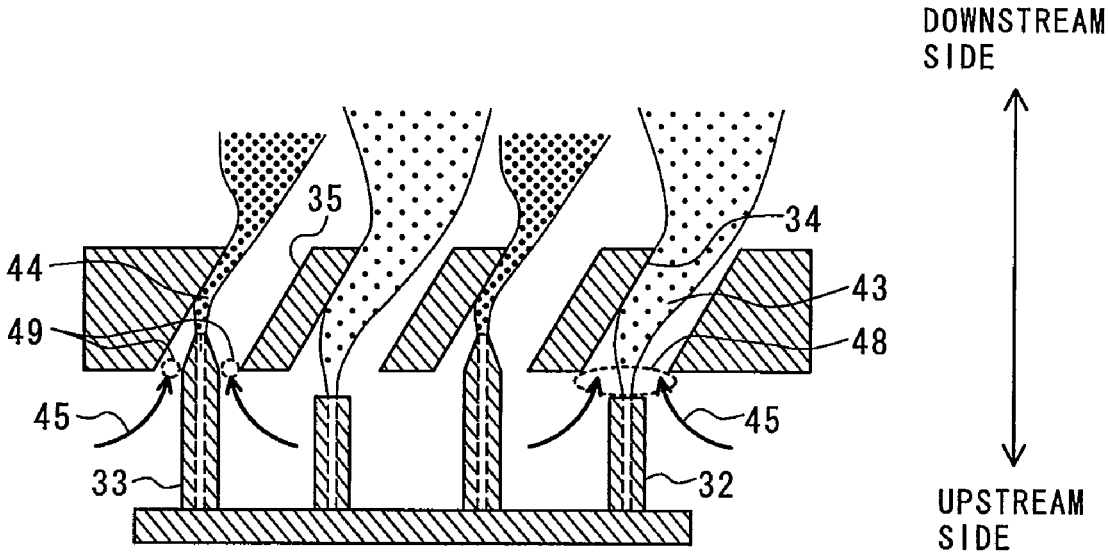
FIG. 4 is a development view illustrating the air holes and fuel nozzles of the first row in the first embodiment.

Unlike the fuel nozzle 33, the fuel nozzle 32 shown in FIGS. 1A, 1B and 2 is shaped cylindrical without the provision of the tapered leading end portion. However, the shape of the fuel nozzle 32 is not limited to this. Incidentally, the leading end portion having no taper or the like reduces the number of fabrication steps; therefore, fabrication costs can be suppressed. Other shapes include also the leading end portion of the fuel nozzle 32 being tapered as shown in FIG. 4. In this case, even if the tip of the fuel nozzle 32 is made close to the inlet of the air hole 34, the inflow of air is not largely obstructed to keep the area of an opening portion 48 sufficiently wide. Thus, the fuel nozzle 32 can ensure an amount of air sufficiently larger than that of air flowing into the air hole 35 paired with the fuel nozzle 33. Consequently, the respective amounts of air flowing into the air holes 34 and 35 can be made to have a relatively large difference therebetween. In this way, the premix flames are formed in the downstream zone 46 of the air hole 34, whereas the diffusion flames can stably be formed in the downstream zone 47 of the air hole 35. Thus, the diffusion flames can improve flame stability. In addition, since also the premix flames can be formed, the flame stability and low NOx emissions can be compatible with each other.

Incidentally, in the embodiment, since the air holes of the first row from the burner plane center can provide the sufficient flame stability, outer circumferential side (a second row 52) air holes may be provided with an inclination angle when flames need to largely broaden outwardly.

Second Embodiment

Figure 5:
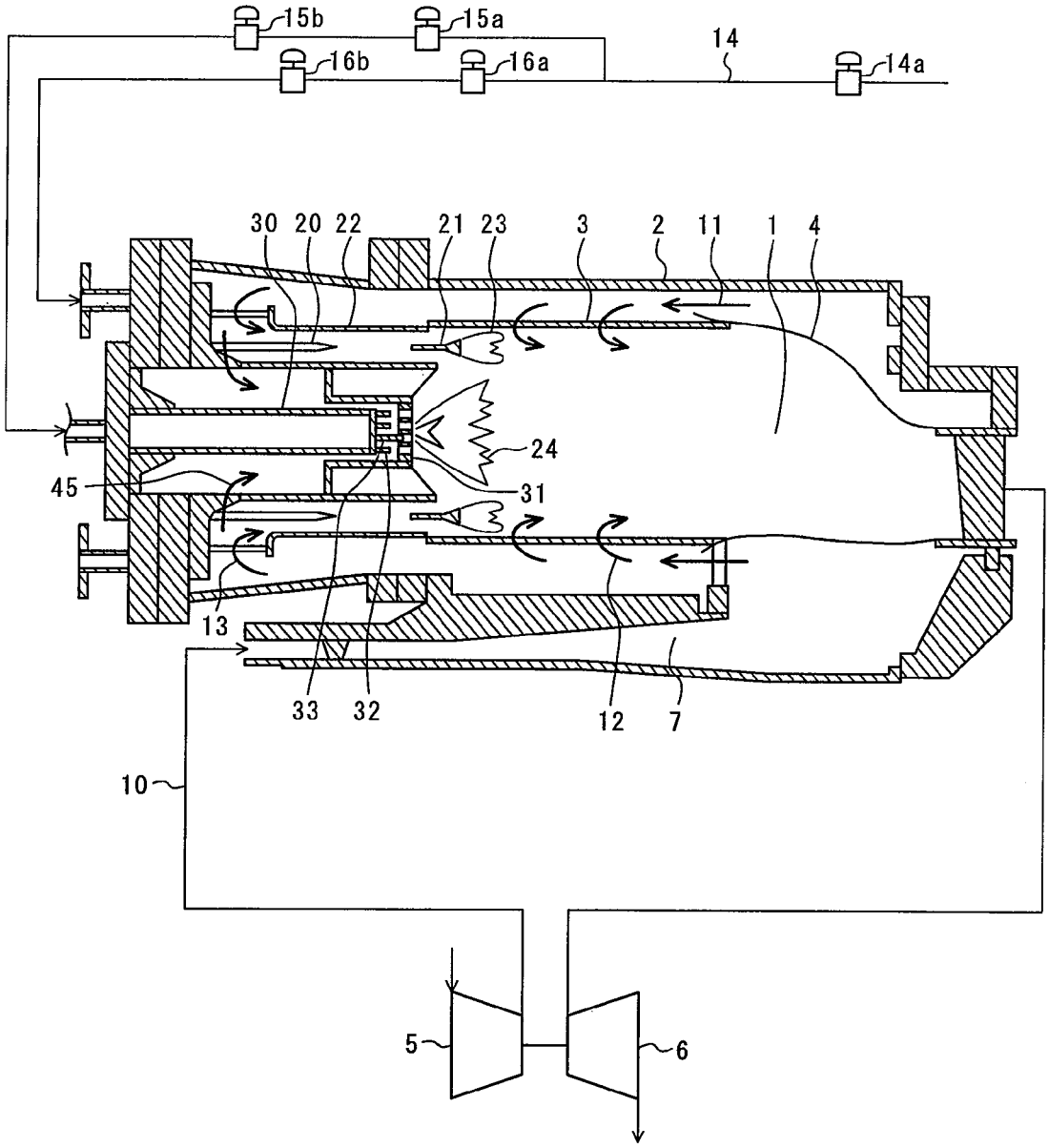
FIG. 5 is a schematic diagram of a gas turbine combustor according to a second embodiment of the present invention.
Figure 6:
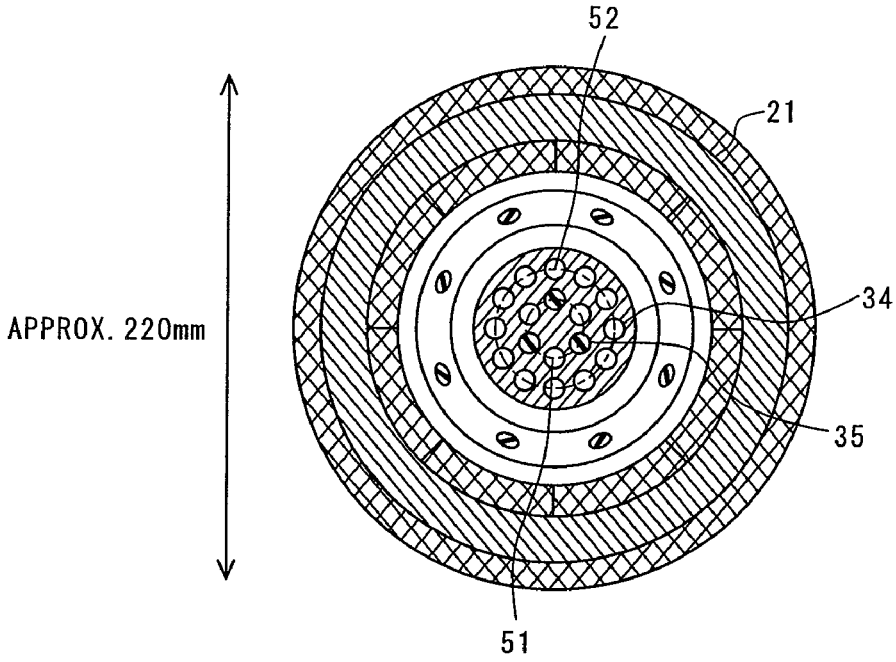
FIG. 6 is a front view of a burner of the second embodiment.

A second embodiment is described in which the burner structure of the invention is applied to a pilot burner of a combustor. In the embodiment, a premix gas turbine combustor is described as one example of the combustor. FIG. 5 schematically illustrates the whole of a gas turbine. FIG. 6 is a front view of a burner.

Compressed air 10 delivered from a compressor 5 flows in a combustor through a diffuser 7 and passes through between an external cylinder 2 and a combustor liner 3. A portion of the compressed air 11 flows into a chamber 1 as cooling air for the combustor liner 3. The remainder of the compressed air 11 passes through a premix passage 22 and an air hole member 31 as combustion air 13 and 45, respectively, and flows into the chamber 1. Fuel and the air are mixed and burned inside the combustor 1 to create combustion gas. The combustion gas is discharged from the combustor liner 3 and supplied to a turbine 6.

In the embodiment, a fuel supply system 14 with a control valve 14*a* is divided into fuel supply systems 15 and 16. The fuel supply systems 15 and 16 are provided with control valves 15*a* and 16*a*, respectively, and can individually be controlled. Shutoff valves 15*b* and 16*b* are provided at the downstream of the control valves 15*a* and 16*a*, respectively. A fuel header 30 adapted to feed fuel to a pilot burner is connected to the fuel supply system, 15 and a fuel nozzle 20 of a premix burner is connected to the fuel supply system 16.

As shown in FIGS. 5 and 6, the combustor of the embodiment includes a burner of the invention located at an central portion (the pilot burner) and an annular premix burner around the pilot burner. The pilot burner and the premix burner each have a diameter of about 220 mm as viewed from the chamber 1. As with the first embodiment, the burner of the central portion includes the fuel header 30, a plurality of fuel nozzles 32, 33 connected to the fuel header 30, and an air hole member 31 bored with a plurality of air holes. The air hole member 31 is located at an upstream side wall surface of the chamber 1. The air holes are concentrically arranged into two rows. In a first row 51, air holes 34 and air holes 35 are alternately arranged. As with FIG. 2, the air hole 34 is paired with the fuel nozzle 32 and the tip of the fuel nozzle 32 is located on the upstream side of the inlet (the upstream side end face) of the air hole 34. The air hole 35 is paired with the fuel nozzle 33 with a tapered leading end portion. The tip of the fuel nozzle 33 is inserted toward the downstream side from the inlet of the air hole 35.

The premix burner disposed on the outer circumferential portion includes the fuel nozzles 20, a premix passage 22 and flame stabilizers 21 disposed at an outlet. In the premix burner, the fuel jetted out from the fuel nozzles 20 are mixed with the combustion air 13 in the premix passage 22 and jetted out as pre-mixture into the chamber 1. Since the flame stabilizers 21 are disposed at the outlet of the burner to radially divide the premix passage 22 in two, a recirculation flow 23 is formed just downstream of the stabilizer 21 to keep flames thereat.

Figure 7:
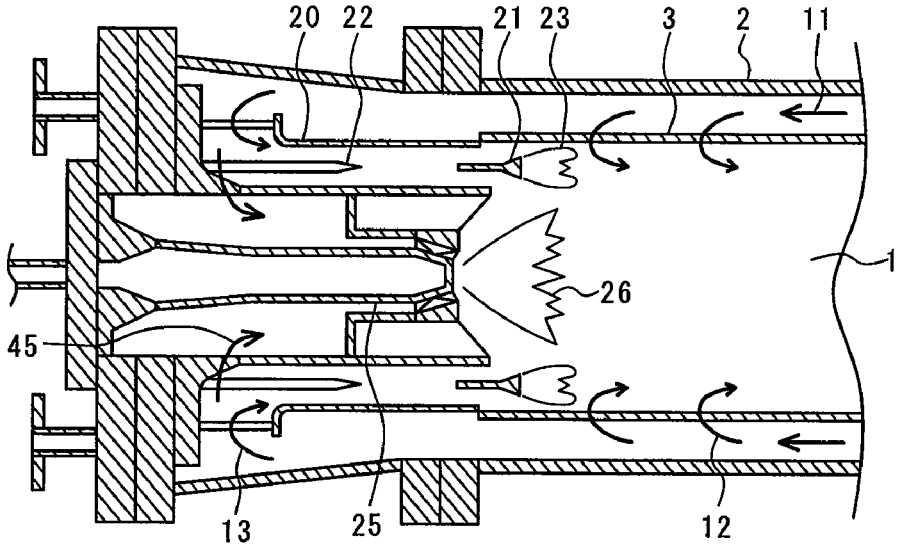
FIG. 7 is a lateral view of a gas turbine combustor according to a comparative example.

FIG. 7 shows a premix gas turbine combustor that uses a pilot burner different from that of FIG. 5 by way of comparative example. The gas turbine combustor of the comparative example includes a diffusion burner 25, as a pilot burner at the central portion thereof, which forms diffusion flames 26 in the chamber 1. The heat and radicals produced by the diffusion flames 26 propagate to the outer circumferential portion, thereby assisting the stable combustion of the flames formed downstream of the flame stabilizer 21. However, to maintain the function of the pilot burner, flames formed by the pilot burner need a definite size. Because of this, the diffusion combustion accounts for a certain ratio of the entire flames in the combustor; therefore, a reduction in the NOx emissions of the entire combustor is limited.

Figure 23A:
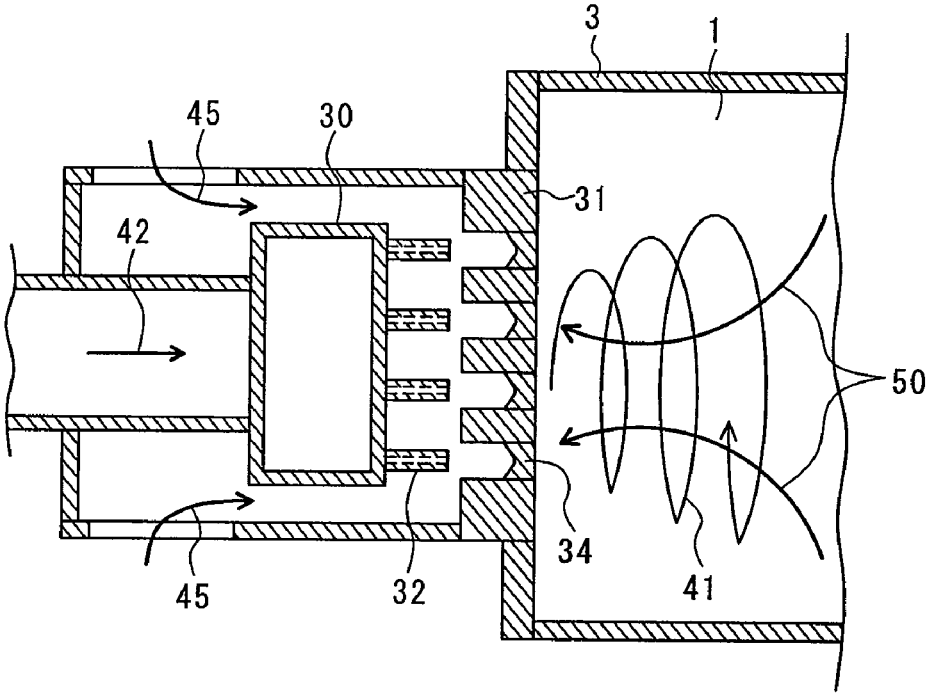
FIG. 23A is a lateral cross-sectional view of a burner according to a comparative example, the burner being able to be replaced with the diffusion burner of the second embodiment, taken along line X-X of FIG. 23B.
Figure 23B:
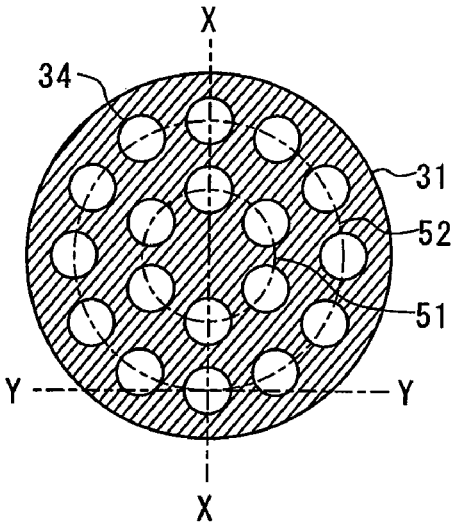
FIG. 23B is a front cross-sectional view of the burner.
Figure 23C:
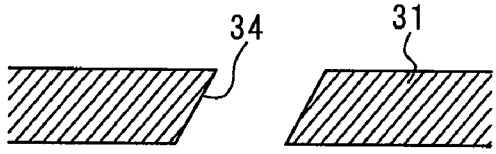
FIG. 23C is a cross-sectional view taken along line Y-Y of FIG. 23B.

To eliminate such a limitation, it could be conceivable that the diffusion burner 25 is replaced with a burner composed of a large number of air holes 34 and fuel nozzles 32 shown in FIG. 23. The burner of FIG. 23 includes an air hole member 31 provided with a plurality of the air holes 34 and the fuel nozzles 32 adapted to jet out fuel from the upstream side of the air hole member 31 into corresponding air holes 34. In addition, an inlet center of the air hole 34 is located on the central axis of the fuel nozzle 32. However, the burner of FIG. 23 is such that the leading end portion of the fuel nozzle 32 is not provided with taper which is configured to suppress the turbulence of air flow. In addition, all the air holes 34 have an angle of traverse relative to the burner central axis. The tips of all the fuel nozzles 32 are each disposed on the upstream side of the inlet of the air hole 34. Thus, it is probable that the fuel jetted out from the fuel nozzle 32 forms an annular air flow on the outer circumferential side of the fuel flow inside the air hole 34, which progresses the premixing of the fuel with the air. Since a zone where fuel is locally rich does not exist at the outlet of the air hole 34, the entire flames provide premix combustion. This can reduce the NOx emissions of the pilot burner. However, since the combustion stability required for the pilot burner is insufficient, reliability is largely impaired to cover wide operating conditions.

In contrast to this, the gas turbine combustor of FIG. 5 is provided with the burner of the present invention as a pilot burner. Therefore, flames 24 formed downstream of the burner become premix-flames stabilized originating in the limited diffusion combustion zone. Thus, NOx emissions can be reduced compared with those of the premix gas turbine combustor using the diffusion burner as the pilot burner. In addition, since the flame bases are stably held by the diffusion combustion zone, combustion stability can be improved compared with the case where all the fuel nozzles 32 are disposed on the upstream side of the air hole inlets as shown in FIG. 23.

The air holes of the first row from the burner plane center of the air hole member 31 have the angel of traverse relative to the burner central axis. Therefore, the flames jetted out from the pilot burner become stable inverse-conical flames. These flames can supply heat and radicals to recirculation flow 23 jetted out from the premix burner, whereby the flames by the premix burner can be keep stable.

As described above, the gas turbine combustor of the embodiment can be operated under wide operating conditions similarly to the diffusion burner without largely impairing flame stability compared with the premix gas turbine combustor using the diffusion burner as the pilot burner. In addition, the gas turbine combustor of the embodiment can more reduce NOx emissions than the premix combustor using the diffusion burner as the pilot burner. Further, the existing premix gas turbine combustor can reduce NOx emissions by converting the diffusion burner into the burner of the embodiment while dealing with wide operating conditions.

Third Embodiment

In recent years, gas turbines have been required to have the broad versatility of fuel because of the issue of depleted energy resources. Fuel having a high hydrogen content increases burning velocity, whereas fuel having a high nitrogen content lowers flame temperature to decrease burning velocity. Thus, fuel characteristics largely vary depending on the fuel compositions. This needs to tune the arrangement and number of air holes in accordance with the fuel composition. In addition, NOx emissions, an operating range, etc. required vary depending on gas turbine-use regions. It is also necessary to flexibly deal with them. To meet the necessity, the arrangement variations of the pairs of the fuel nozzles 32 and air holes 34 and the pairs of the fuel nozzles 33 and the air holes 35 in the first embodiment are changed to enable the control of the NOx emissions and of flame stability.

Figure 8:
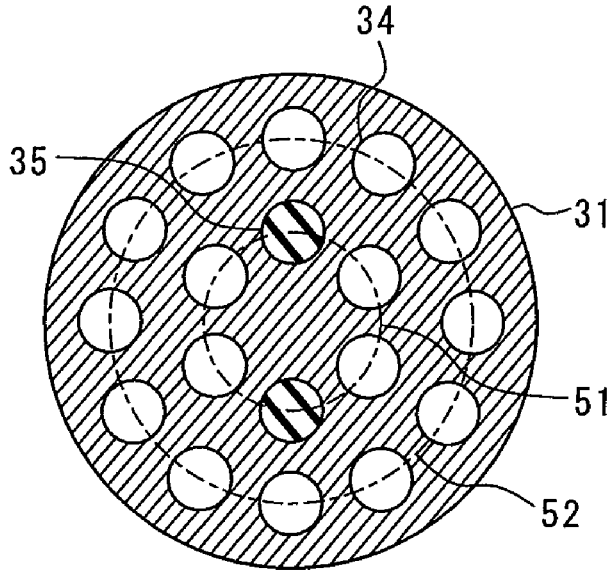
FIG. 8 is a front view of a burner according to a third embodiment of the invention.

FIG. 8 is a front view of a burner according to a third embodiment. In the present embodiment, all air holes arranged in two concentric rows are formed to have an angle of traverse. Six air holes arranged in a first row 51 consist of two air holes 35 arranged to face each other and the remaining air holes 34. The arrangement relationship between the air hole and the fuel nozzle is the same as that described with FIG. 2. Specifically, for the air hole 34, the tip of the fuel nozzle 32 is disposed on the upstream side of the air hole inlet. In addition, for the air hole 35, the tip (tapered) of the fuel nozzle 33 is disposed on the downstream side of the air hole inlet thereof.

In the present embodiment, the number of the air holes 35 is reduced by one compared with that of the first embodiment. Therefore, the diffusion combustion zone of the entire flames is reduced to enable a reduction in NOx emissions. However, the diffusion combustion zone largely contributing to flame stability at the flame base is reduced and the diffusion combustion zones are distant from each other. When the respective diffusion combustion zones formed by the two air holes 35 are too distant from each other, there is a possibility that a zone to which sufficient heat and radicals are not supplied is created in the burner central zone which is the origination of stabilized flames. Thus, it is probable that the flame stability is inferior to that in the first embodiment; however, NOx emissions can further be reduced.

Fourth Embodiment

Figure 9:
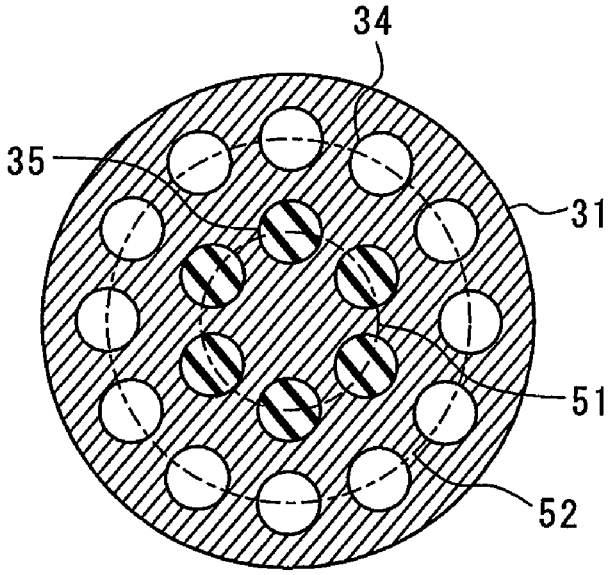
FIG. 9 is a front view of a burner according to a fourth embodiment of the invention.

FIG. 9 is a front view of a burner according to a fourth embodiment. Also in the present embodiment, all air holes arranged in two concentric rows are formed to have an angle of traverse. In the embodiment, all air holes 35 paired with corresponding fuel nozzles 33 are arranged in an inner circular, first row 51. The tip of the fuel nozzle 33 is inserted from an air hole inlet toward the downstream side. This forms inverse-conical flames downstream of the burner. Zones becoming the originations of stabilized flames provide continuous diffusion combustion, which more strengthens flame stability than the first embodiment. This can broaden the operating range of gas turbine load operation. In addition, this can allow fuel high in nitrogen and low in reactivity to keep stable flames. However, since diffusion combustion zones are more increased than those in FIG. 1, NOx emissions are increased when the same fuel is used.

In a modification of the present embodiment, it could be conceivable that the air holes of a second row 52 are not formed to have an angle of traverse. In this case, the air holes of the second row 52 can each be bored by vertically drilling an air hole member 31. Thus, machining costs can be reduced. Incidentally, although a swirl flow formed downstream of the burner is small, the burner of the embodiment used alone poses no problem. Even in the case where the burner of the embodiment is used as a pilot burner, when such burner may be located adjacently to other burners, it can sufficiently play a roll of a pilot burner because the flames formed by such a burner can sufficiently supply heat and radicals to the peripheral burners.

Incidentally, a configuration in which the air holes of a second row are not formed to have an angle of traverse and are formed as passages each vertical to the air hole member 31 is effective in the other embodiments.

Fifth Embodiment

Figure 10:
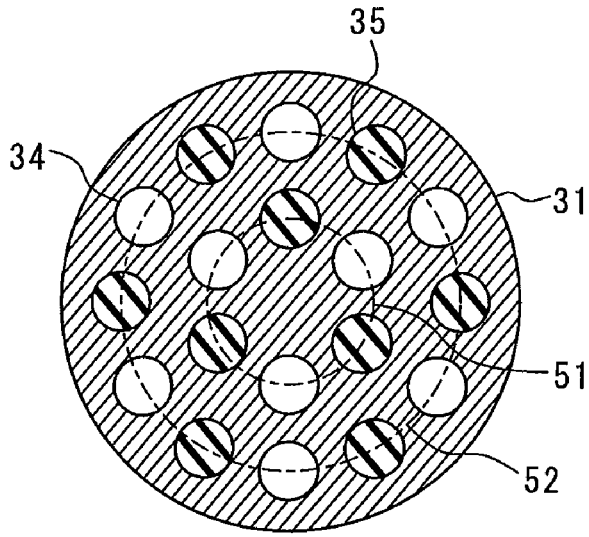
FIG. 10 is a front view of a burner according to a fifth embodiment of the invention.

FIG. 10 is a front view of a burner according to a fifth embodiment. All air holes of the present embodiment are formed to have an angle of traverse relative to a burner central axis. Air holes 34 and 35 are alternately arranged in a first row 51 and in a second row 52. Specifically, as with the first embodiment, the air hole 34 is paired with the fuel nozzle 32, and the tip of the fuel nozzle 32 is located on the upstream side of the inlet (the upstream side end face) of the air hole 34. In addition, the air hole 35 is paired with the fuel nozzle 33 and the tip of the fuel nozzle 33 is inserted from the inlet of the air hole 35 toward the downstream side. In the embodiment, the number of the air holes 34 is equal to that of the air holes 35 so that the area of the premix combustion zone is generally equal to that of the diffusion combustion zone. While a NOx reduction effect for the diffusion burner is slightly reduced, the flame stability is improved compared with that of the embodiment described above. Thus, even low-calorie fuel containing a high proportion of nitrogen or fuel which is low in burning velocity can keep flame stability, that is, the embodiment is effective.

Sixth Embodiment

The burners in the embodiments described thus far are configured to have the air holes concentrically arranged in the two rows. However, fuel to be consumed and an amount of air to be supplied are largely different depending on objects to which the burners are applied. For example, a gas turbine combustor is such that an amount of supply air and a fuel flow rate are increased with an increase in output of power generation. This needs to enlarge the entire combustor and increase the size of the burner. When the diameter of an air hole is increased with the number of air holes remaining unchanged, the volume of the air holes adapted to premix fuel with air is increased, which deteriorates mixing performance to probably increase NOx emissions. Consequently, when the first embodiment deals with an increase in an amount of air and in a flow rate of fuel, it is effective to increase the number of rows of the fuel nozzles and of the air holes without the analogous enlargement of the burner.

When the burner of the present invention is used as a pilot burner of a gas turbine combustor, it is necessary to improve the flame stability of the entire combustor by increasing the size of flames formed by the pilot burner depending on the kinds of fuel. For this reason, it is effective to increase the rows of the fuel nozzles and of air holes.

Figure 11:
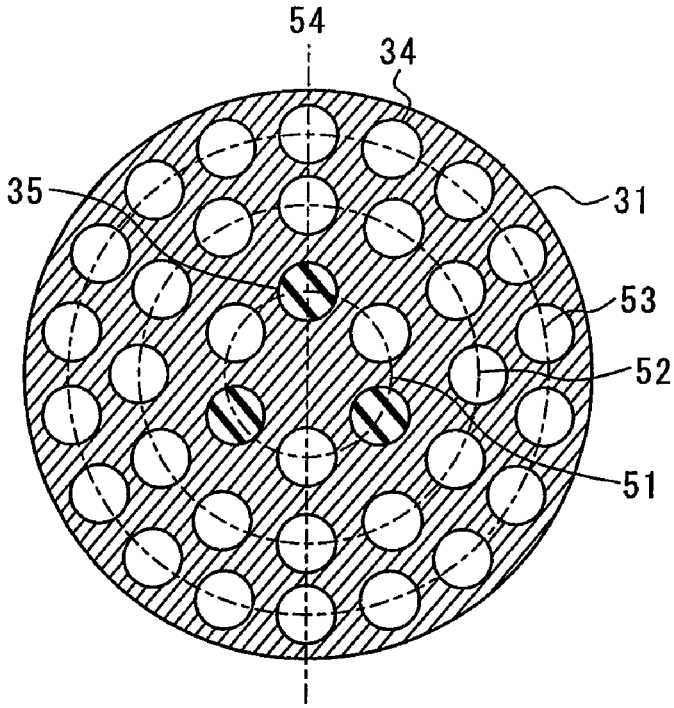
FIG. 11 is a front view of a burner according to a sixth embodiment of the invention.

FIG. 11 is a front view of a burner according to a sixth embodiment. The present embodiment increases the number of air hole rows, compared with that of the first embodiment, that is, from two to three. As described above, the present embodiment is effective when supplying more air and fuel to the chamber is required than the first embodiment or when forming larger flames is required than the first embodiment. It is also possible to increase the number of rows from three to four, five or more.

In the present embodiment, only three pairs of fuel nozzles 33 and air holes 35 are arranged in a first row 51 of the entire rows. The tip of the fuel nozzle 33 is inserted from the inlet of the air hole 35 toward the downstream side. Fuel and air are not virtually mixed with each other and are jetted out from the air holes 35 into the chamber. Thus, the fuel jetted out from the air hole 35 is consumed by diffusion combustion. However, since the percentage of the diffusion combustion zone relative to the entire flames is small compared with that of the first embodiment, the NOx emissions discharged from the entire combustor is suppressed to a low level.

Figure 12:
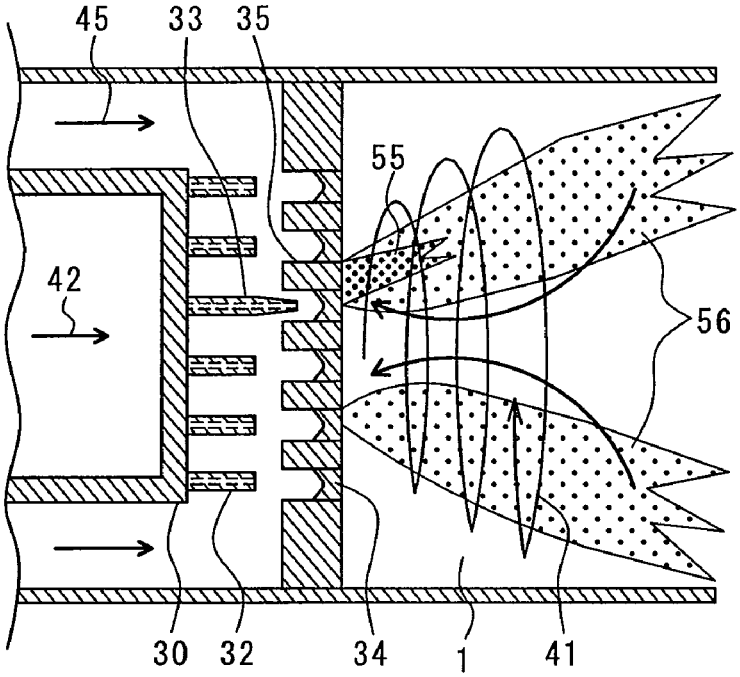
FIG. 12 is a schematic lateral cross-sectional view of the sixth embodiment, illustrating flames.

FIG. 12 is a schematic cross-sectional view of flames formed by the burner of the present embodiment, taking along a centerline 54 of FIG. 11. In FIG. 11, all the air holes are formed to have an angle of traverse. Referring to FIG. 12, the cross-sectional view taken along the centerline 54, the air holes are apparently formed vertical to the air hole member.

As described in the first embodiment, a diffusion combustion zone 55 is formed in the downstream portion of the air hole 35 also in the present embodiment. Premix gas around thereof receives heat and radicals supplied from the diffusion combustion zone 55 to form premix flames 56 while spreading toward the outer circumferential side of the downstream rearward. The air holes 34 of the first row 51 are paired with the corresponding fuel nozzles 32. The tip of the fuel nozzle 32 is disposed on the upstream side of the air hole inlet. Thus, premix gas is jetted out from the air hole 34. Since the air hole 34 is circumferentially adjacent to the diffusion combustion zone, sufficient heat can be supplied to the premix gas so as to stably keep the premix flames in the vicinity of the outlet of the first row air hole. Since the first row air holes are formed to have an angle of traverse relative to the burner central axis, the premix flames 56 are formed toward the downstream while spreading toward the outer circumferential side. The diffusion combustion zone 55 is produced at the root to become an origin for stabilizing the inverse conical premix flames 56 to stabilize flames. Thus, the number of the concentric air hole rows is increased from two to three without increasing the diffusion combustion zone 55, which can stably burn the entire flames without impairing flame stability.

When the second row air holes 52 and the third row air holes 53 are formed to have an angle of traverse, the effect of the embodiment can provide further flame stability.

Seventh Embodiment

As described in the sixth embodiment, the entire flames can be stably kept by a portion of the flame base subjected to diffusion combustion. However, when the burner of the present invention is used as a pilot burner, stable combustion under wide operating conditions is required, and the burner plays a role of supplying heat to adjacent peripheral premix burners to ignite them and complementing flame stability. This may need further flame stability in some cases. When fuel low in calorie and slow in burning velocity is used, premix flames may disappear halfway so that fuel may not completely react, that is, unburned carbon hydride and carbon dioxide may be discharged. With that, embodiments that further strengthen flame stability are described below.

Figure 13:
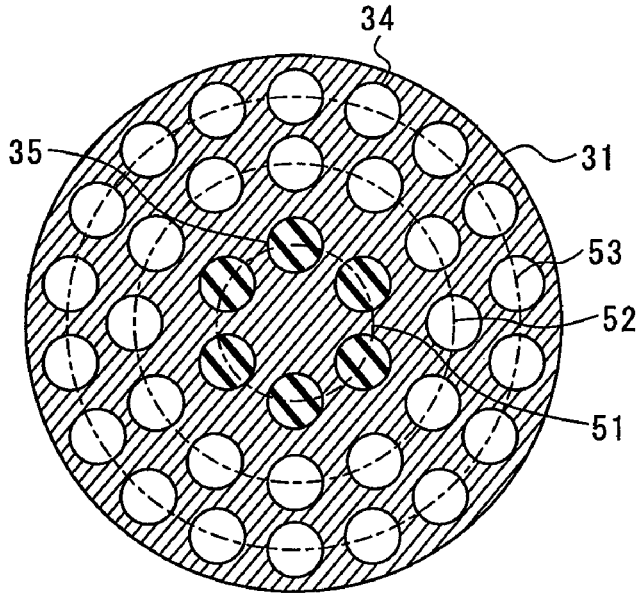
FIG. 13 is a front view of a burner according to a seventh embodiment of the invention.

In an embodiment of FIG. 13, all air holes of a first row 51 are paired with corresponding fuel nozzles 33 so that a diffusion combustion zone is circumferentially formed at the air hole outlets of the first row 51. The entire zone of an inverse-conically formed flame base is subjected to the diffusion combustion; therefore, flame stability can be improved. When the burner of this embodiment is used as a pilot burner of a gas turbine combustor, the improved flame stability can expand the applicable range of gas turbine load operation.

Figure 14:
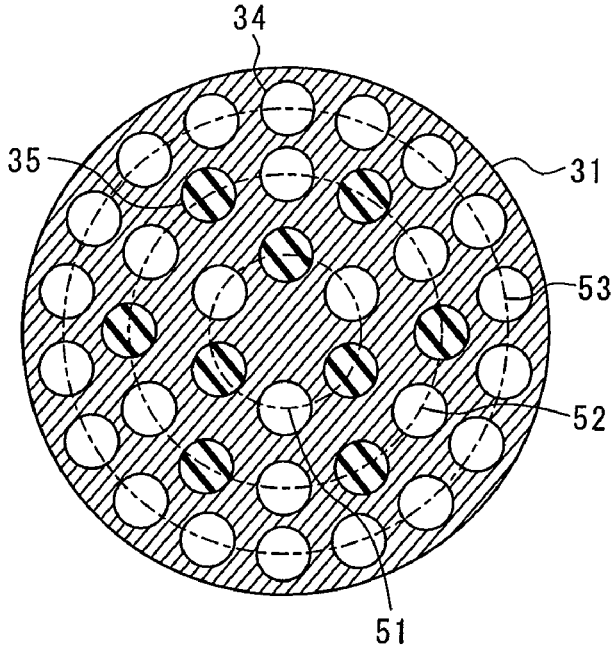
FIG. 14 is a front view of another burner according to the seventh embodiment of the invention.
Figure 15:
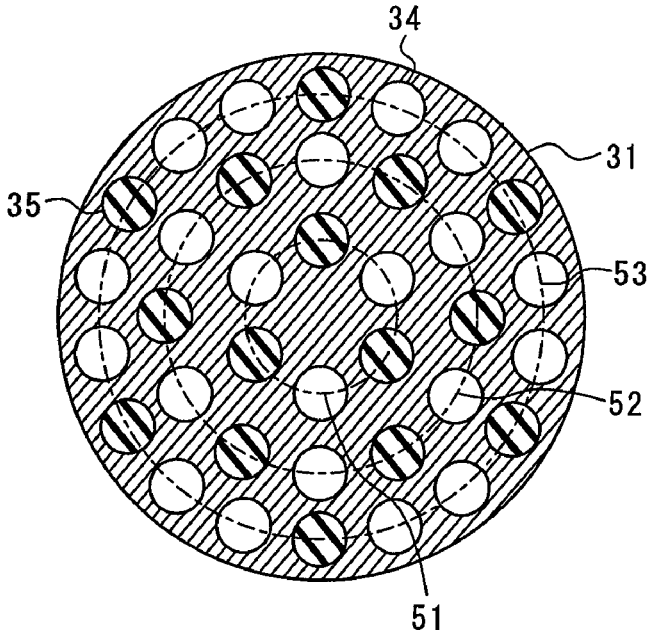
FIG. 15 is a front view of another burner according to the seventh embodiment of the invention.

An embodiment of FIG. 14 is such that air holes 35 paired with corresponding fuel nozzles 33 are alternately arranged in the air holes of a second row 52 in addition to the air holes 35 of the first row 51 of FIG. 11. In FIG. 15, air holes 35 pared with corresponding fuel nozzles 33 are further arranged every three in the air holes of a third row 53. With such configurations, the diffusion combustion zones are formed also on the outside of flames formed at the burner to thereby enable supply of sufficient heat and radicals to the outer circumferential side of the flames. This can prevent even low-calorie non-flammable fuel from generating unburned carbon hydride and carbon monoxide. However, the increased diffusion zones also increase NOx emissions; therefore, it is preferred that the number of pairs of the fuel nozzles 33 and the air holes 35 be reduced as much as possible.

In FIG. 14, the pairs of the fuel nozzles 33 and air holes 35 are alternately arranged in the second row 52. In FIG. 15, the pairs of the fuel nozzles 33 and air holes 35 are arranged every two in the second row 52 and every three in the third row 53. The number of pairs of the fuel nozzles 33 and air holes 35 is adjusted to suit fuel used and operating conditions, whereby the NOx emissions can be minimized while satisfying performance for necessary combustion stability.

The embodiments have described thus far the burners having the increased number of the rows of the fuel nozzles and air holes in order to deal with the increase in the flow rates of air and fuel to be supplied. Other measurements include increasing the number of the air holes in the first row 51 from six to eight or ten. In response to this, also the respective numbers of the air holes in the second row 52 and other rows can be increased to radially enlarge the size of the burner.

Figure 16:
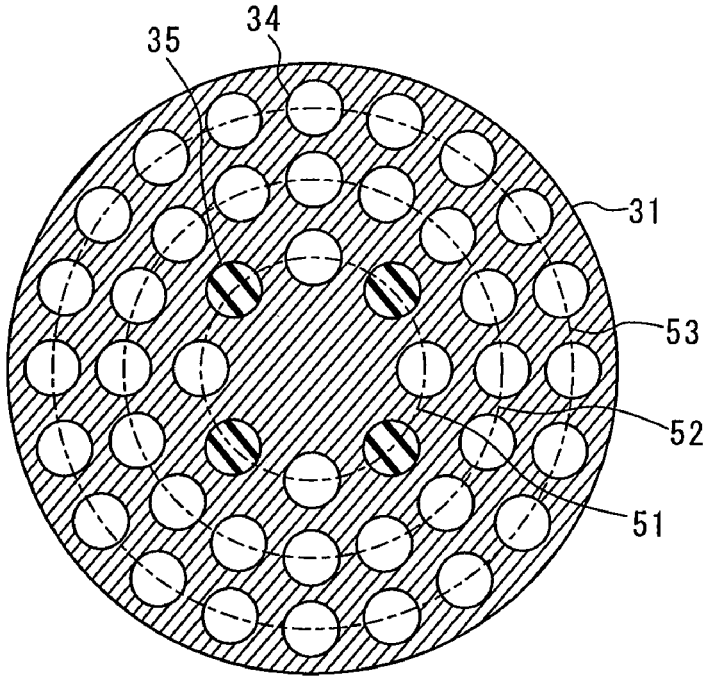
FIG. 16 is a front view of another burner according to the seventh embodiment of the invention.

FIG. 16 illustrates the case where the number of air holes in a first row 51 is eight. Air holes 35 paired with corresponding fuel nozzles 33 are alternately arranged in the air holes of the first row 51. Changing the number of air holes for each row as mentioned above is also effective in a burner having air holes of two rows.

Figure 17:
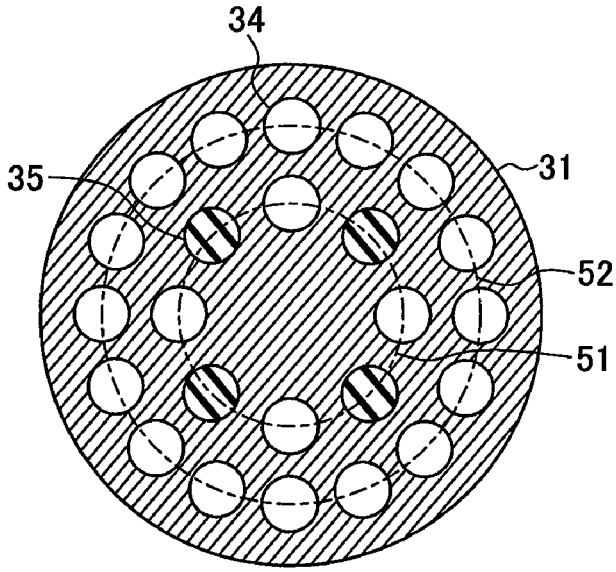
FIG. 17 is a front view of another burner according to the seventh embodiment of the invention.

FIG. 17 illustrates the case where the number of air hole rows is two and the number of air holes in a first row 51 is eight. When increasing the number of air hole rows by one excessively enlarges the burner itself, the size of the burner can be accommodated by increasing the number of air holes for each row. Since increasing the number of air holes in the first row 51 expands the whole of the first row outwardly, a recirculation zone formed downstream of the burner central portion expands, thereby also providing an effect of improving flame stability.

Eighth Embodiment

Figure 18:
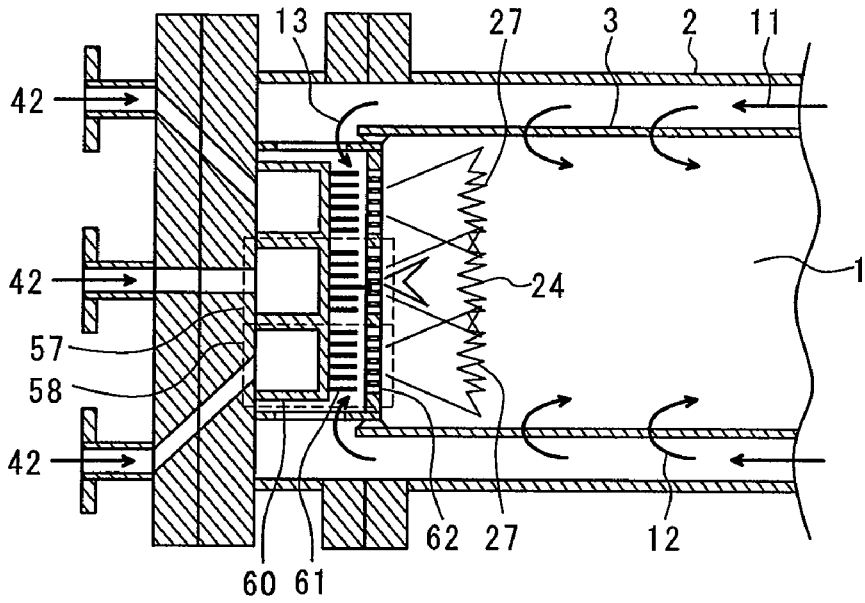
FIG. 18 is a lateral cross-sectional view of a gas turbine combustor according to an eighth embodiment of the invention.
Figure 19:
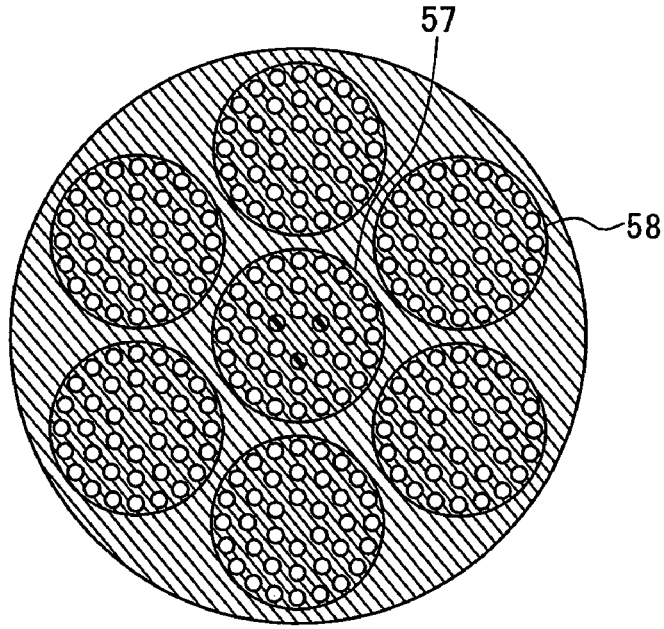
FIG. 19 is a front view of burners according to the eighth embodiment of the invention.

An eighth embodiment is described with reference to FIGS. 18 and 19. FIG. 18 is a lateral cross-sectional view of a gas turbine combustor and FIG. 19 is a front view of burners. In the present embodiment, the gas turbine combustor includes a large number of burners provided with air hole members, the burners being arranged on the upstream side of a chamber, and the present invention is applied to a central burner 57 of the burners. Six external burners 58 each including a fuel header 60, fuel nozzles 61 and air holes 62 are arranged on the outer circumferential side of the central burner 57. Fuel supplied to the burners is individually controlled. The fuel supplied to each fuel header 60 is distributed to the plurality of fuel nozzles 61 connected to the fuel header 60, jetted out from the fuel nozzles 61, then passing through the air holes 62, and jetted out into the chamber 1.

The external burners 58 are such that the tips of all the fuel nozzles are disposed on the upstream side of the air hole inlet. With this configuration, air flow is formed on the outer circumferential side of fuel flow in the air hole to premix fuel with air. In this case, since the volume of the air in the air hole is smaller than that of the chamber 1, sufficient mixing can be achieved even in the short distance. Thus, premix flames 27 are formed on the downstream side of the external burner 58.

As described in the second embodiment, the gas turbine needs to operate under the wide conditions from start to a rated load. In particular, since a fuel air ratio is low at a local portion of a burner under starting conditions or conditions after switching of fuel systems, flame stability is very important. Because of this, the burner located at the center uses the burner of the invention to improve the flame stability of the central burner. Thus, high reliability can be obtained under the conditions from start to the increased rotation number of the gas turbine. Also premix flames 27 formed on the downstream side of the external burner 58 receive heat and radicals supplied from stable flames 24 formed on the downstream side of the central burner 57; therefore, it improves flame stability. However, since NOx discharged from the central burner 57 is increased, it is preferred that the number of the pairs of fuel nozzles 33 and air holes 35 is reduced as much as possible in order to reduce the range of the diffusion combustion zone formed by the central burner 57.

Ninth Embodiment

Figure 20:
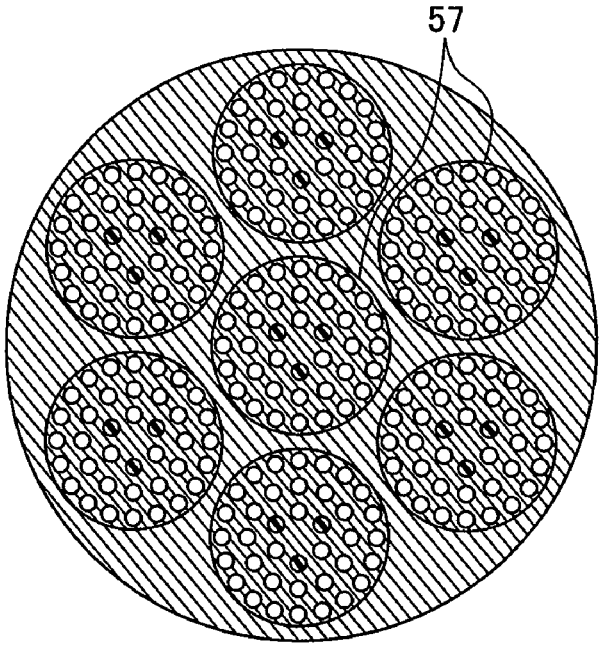
FIG. 20 is a front view of burners according to a ninth embodiment of the invention.

FIG. 20 illustrates a ninth embodiment in which also the external burners 58 of the eighth embodiment are replaced with the burners of the present invention. In the present embodiment, since flames formed by each burner have the diffusion combustion zone, then NOx emissions will be increased but the stability of flames formed by each burner is improved. Very non-flammable fuel low in burning velocity, such as e.g. low calorie fuel may be used as fuel for the gas turbine. Even in such a case, flame bases formed by the burners are formed with the diffusion combustion areas, whereby flames can stably be kept to enable reliable operation of the gas turbine. In addition, the expansion of the applicable range of the gas turbine load operation can concurrently be achieved.

What is claimed is:

1. A burner comprising:

an air hole member provided with a plurality of air holes arranged in a plurality of concentric rows on a combustion gas flow directional upstream side of a chamber adapted to generate combustion gas; and fuel nozzles adapted to jet out fuel to the corresponding air holes from a fuel jetting-out directional upstream side of said air hole member, an inlet center of each of the air holes being located on a central axis of a corresponding one of said fuel nozzles;

wherein the air holes of said air hole member are each formed to have a central axis inclined relative to a central axis of the burner;

a first fuel nozzle has a leading end portion configured to be able to suppress turbulence of air-flow flowing on an outer circumferential side of the first fuel nozzle, and a tip of the first fuel nozzle is disposed on a fuel jetting-out directional downstream side of the air hole inlet; and a second fuel nozzle has a tip disposed on a fuel jetting-out directional upstream side of the air hole inlet.

2. The burner according to claim 1, wherein a plurality of the burners are arranged to constitute a combustor.

3. A burner comprising:

an air hole member provided with a plurality of air holes arranged in a plurality of concentric rows on a wall surface, on a combustion gas flow directional upstream side, of a chamber adapted to generate combustion gas;

a plurality of fuel nozzles each disposed to face a corresponding one of the air holes and adapted to jet out fuel from a fuel jetting-out directional upstream side of said air hole member, an inlet center of each of the air holes being located on a central axis of a corresponding one of the fuel nozzles;

a fuel header adapted to distribute fuel to said fuel nozzles; and a fuel header housing section adapted to housing said fuel header therein and provided with an air inflow hole on the fuel jetting-out directional upstream side of said fuel header;

wherein the air holes in a first row from a burner plane center of said air hole member have an air hole central axis inclined relative to a burner central axis;

tips of said fuel nozzles are each disposed in the vicinity of an inlet of the air hole adapted to receive air flowing thereinto from the air inflow hole;

a leading end portion of a first fuel nozzle is tapered and a tip of the first fuel nozzle is inserted into a corresponding one of the air holes in the first row; and a tip of a second fuel nozzle is disposed on the upstream side of inlets of the air holes in the first row.

4. The burner according to claim 3, wherein the first fuel nozzles and the second fuel nozzles in the first row are alternately arranged in a circumferential direction.

5. The burner according to claim 3, wherein the first fuel nozzle and the second fuel nozzle are circumferentially alternately arranged to correspond to the air holes in the first row and in a second row from the burner plane center.

6. A combustor comprising:

a pilot burner disposed on a combustion gas flow directional upstream side of a combustor liner; and an annular premix burner disposed on an outer circumferential side of said pilot burner;

wherein said pilot burner includes:

an air hole member provided with a plurality of air holes in a plurality of concentric rows; and fuel nozzles adapted to jet out fuel to a corresponding one of the air holes from a fuel jetting-out directional upstream side of the air hole member, an inlet center of each of the air holes being located on a central axis of a corresponding one of the fuel nozzles; and wherein the air holes in a first row from a burner plane center of the air hole member have an air hole central axis inclined relative to a burner central axis;

a leading end portion of a first fuel nozzle is tapered, and a tip of the first fuel nozzle is disposed on a downstream side of inlets of the air holes in the first row; and a tip of a second fuel nozzle is disposed on an upstream side of inlets of the air holes in the first row.

7. The combustor according to claim 6, wherein said premix burner includes a premix passage adapted to mix fuel with air and a flame stabilizer disposed at an outlet of the premix passage.

* * * * *